US008022784B2

(12) United States Patent
Lee et al.

(10) Patent No.: US 8,022,784 B2
(45) Date of Patent: Sep. 20, 2011

(54) PLANAR TRANSMISSION LINE-TO-WAVEGUIDE TRANSITION APPARATUS HAVING AN EMBEDDED BENT STUB

(75) Inventors: Jae Jin Lee, Daejeon (KR); Chul Soon Park, Daejeon (KR); Dong Yun Jung, Daejeon (KR); Ki Chan Eun, Daejeon (KR)

(73) Assignee: Korea Advanced Institute of Science and Technology (KAIST), Daejeon (KR)

( * ) Notice: Subject to any disclaimer, the term of this patent is extended or adjusted under 35 U.S.C. 154(b) by 211 days.

(21) Appl. No.: 12/433,116

(22) Filed: Apr. 30, 2009

(65) Prior Publication Data

US 2010/0001808 A1 Jan. 7, 2010

Related U.S. Application Data

(60) Provisional application No. 61/078,546, filed on Jul. 7, 2008.

(51) Int. Cl.
*H01P 5/107* (2006.01)

(52) U.S. Cl. ..... 333/26; 333/34

(58) Field of Classification Search ..... 333/26, 333/34

See application file for complete search history.

(56) References Cited

U.S. PATENT DOCUMENTS 5,982,250 A * 11/1999 Hung et al. ..... 333/26
6,060,959 A * 5/2000 Yakuwa ..... 333/26
6,958,662 B1 * 10/2005 Salmela et al. ..... 333/26
2003/0042993 A1 * 3/2003 Sayanagi et al. ..... 333/26
2006/0182386 A1 * 8/2006 Stenger ..... 385/15

FOREIGN PATENT DOCUMENTS

KR 10-0706024 4/2007

OTHER PUBLICATIONS

"A Novel Approach for a Periodic Structure Shielded Microstrip Line to Rectangular Waveguide Transition", Florian Poprawa et al., IEEE MTT-S Int. Microwave Symp., pp. 1559-1562, Jun. 2007.

"Millimeter-wave microstrip-to-waveguide transition operating over broad frequency bandwidth", Yusuke Deguchi et al,, IEEE MTT-S Int. Microwave Symp., pp. 2107-2110, Jun. 2005.

"Novel GCPW-to-Embedded LTCC Rectangular Waveguide Transition for V-band System-on-Package Applications", Jae Jin Lee et al,, ITC-CSCC 2007, The 22nd International Technical Conference on Circuits/Systems, Computers and Communications, Jul. 8-11, 2007.

* cited by examiner

*Primary Examiner* — Benny Lee
(74) *Attorney, Agent, or Firm* — Bacon & Thomas, PLLC

(57) ABSTRACT

A wireless communication module includes a plurality of monolithic millimeter-wave integrated circuits (MMICs) for signal processing attached to the top surface of a multi-layer low temperature co-fired ceramic substrate; a planar transmission line formed on the top surface of the multi-layer substrate for communications between the MMICs; a metal base attached to the bottom surface of the multi-layer substrate and having an opening to which an antenna is attached; a plurality of vias for connecting the metal base and the planar transmission line within the multi-layer substrate to establish a uniform potential on a ground plane of the multi-layer substrate; an embedded waveguide formed in the opening surrounded with the vias within the multi-layer substrate; and a planar transmission line-to-waveguide transition apparatus for the transition of waves between the planar transmission line and the embedded waveguide.

13 Claims, 7 Drawing Sheets

PLANAR TRANSMISSION LINE-TO-WAVEGUIDE TRANSITION APPARATUS HAVING AN EMBEDDED BENT STUB

FIELD OF THE INVENTION

The present invention relates to wireless communication modules operating at millimeter-wave bands, and more specifically, to a wireless communication module having a built-in planar transmission line-to-waveguide transition apparatus.

BACKGROUND OF THE INVENTION

With exponential demand for wireless communications having high speed and large capacity, high-speed broadband wireless communication techniques have been required to meet such a demand and to process data at a high Gbps transfer rate. In recent developments, millimeter-wave band wireless communication modules having a wide bandwidth have drawn a lot of attention. One of the biggest issues regarding the high-speed broadband wireless communication techniques is to develop small size, low cost wireless communication modules operating at millimeter-wave bands, and this may be achieved in general through the use of a system-in-package (SiP) technique. In the SiP technique, an antenna is an absolute factor that determines the total size of a wireless communication module. However, when the antenna is installed at the same plane as a signal processing circuit, for example, a monolithic millimeter-wave integrated circuit (MMIC), the overall size of the wireless communication module increases and incomplete isolation between the antenna and the signal processing circuit is also likely to degrade the performance of the wireless communication module. As an attempt to resolve these problems, the antenna was attached to the rear side of the wireless communication module, so the wireless communication module was significantly reduced in size, thereby getting the benefits of low cost and small size.

Meanwhile, to reduce a loss between the antenna and the signal processing circuit, the wireless communication module includes a planar transmission line-to-waveguide transition apparatus that connects the antenna and MMIC, through a planar transmission line such as a microstrip line or a coplanar waveguide (CPW), to the waveguide.

For example, a conventional transition apparatus is described in the article by Yusuke Deguchi, Kunio Sakakibara, Nobuyoshi Kikuma and Hiroshi Hirayama, entitled "Millimeter-Wave Microstrip-to-Waveguide Transition Operating over Broad Frequency Bandwidth", which is disclosed in IEEE MTT-S Int. Microwave Symp., pp. 2107-2110, June 2005.

The transition apparatus disclosed in the article by Yusuke Deguchi et al. exhibits low loss wide-band characteristics but has shortcomings in that an upper waveguide has to be manufactured additionally through a mechanical process and that the process of obtaining a certain shape of the upper waveguide is very difficult. This results in an increase in the overall size of the wireless communication module.

Another conventional transition apparatus is found in the article by Florian Poprawa, Andreas Ziroff, and Frank Ellinger, entitled "A Novel Approach for a Periodic Structure Shielded Microstrip Line to Rectangular Waveguide Transition", which is disclosed in IEEE MTT-S Int. Microwave Symp., pp. 1599-1562, June 2007.

The transition apparatus disclosed in the article by Florian Poprawa et al. includes a periodic shield structure for shielding a microstrip line-waveguide transition. However, it requires an additional manufacturing process to attach the periodic shield structure to the microstrip line-waveguide transition part, which renders it difficult to make the wireless communication module small in size.

As described above, the conventional techniques require an additional waveguide structures i.e., an upper waveguide or a periodically structured shield, in addition to the existing waveguide, so as to transmit signals from the antenna that is attached to the rear side of the transition apparatus through the waveguide. Therefore, an additional process is needed for joining those structures with the wireless communication module. As a result, this makes the overall size of the wireless communication module bulky, and also makes the layout of the wireless communication module very complicated which incurs high manufacturing cost as well as brings about a difficulty for making the wireless communication module in small size.

Moreover, problems may occur by processing error during the manufacture of those structures, and the complexity of the matching circuit gets worse.

Therefore, there is a need for a transition apparatus which has a low insertion loss and a wide frequency band, but does not require an additional process in the wireless communication module operating at millimeter-wave bands, thereby realizing a low price transition apparatus of super-small size.

SUMMARY OF THE INVENTION

It is, therefore, an object of the present invention to provide a planar transmission line-to-waveguide transition apparatus having a large bandwidth and low insertion loss, which is suitable for large-capacity wireless communication modules operating at millimeter bands.

In accordance with an aspect of the invention, there is provided a wireless communication module, comprising:

a multi-layer low temperature co-fired ceramic (LTCC) substrate;

a plurality of monolithic millimeter-wave integrated circuits (MMICS) attached to the top surface of the multi-layer substrate for signal processing;

a planar transmission line formed on the top surface of the multi-layer substrate for communications between the MMICs;

a metal base which is attached to the bottom surface of the multi-layer substrate, and has an opening to which an antenna is attached;

a plurality of vias for connecting the metal base and the planar transmission line within the multi-layer substrate to establish a uniform potential on a ground plane of the multi-layer substrate;

an embedded waveguide formed in the opening surrounded with the vias within the multi-layer substrate; and a planar transmission line-to-waveguide transition apparatus for the transition of waves between the planar transmission line and the embedded waveguide.

In accordance with another aspect of the invention, there is provided a planar transmission line-to-waveguide transition apparatus for the transition of waves between a planar transmission line and a waveguide, comprising:

a bent stub that is built in the embedded waveguide and forms a bent loop to connect the planar transmission line to the embedded waveguide so that signal transition occurs therebetween.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE EMBODIMENTS

Hereinafter, exemplary embodiments of the present invention will be described in detail with reference to the accompanying drawings.

Figure 1:
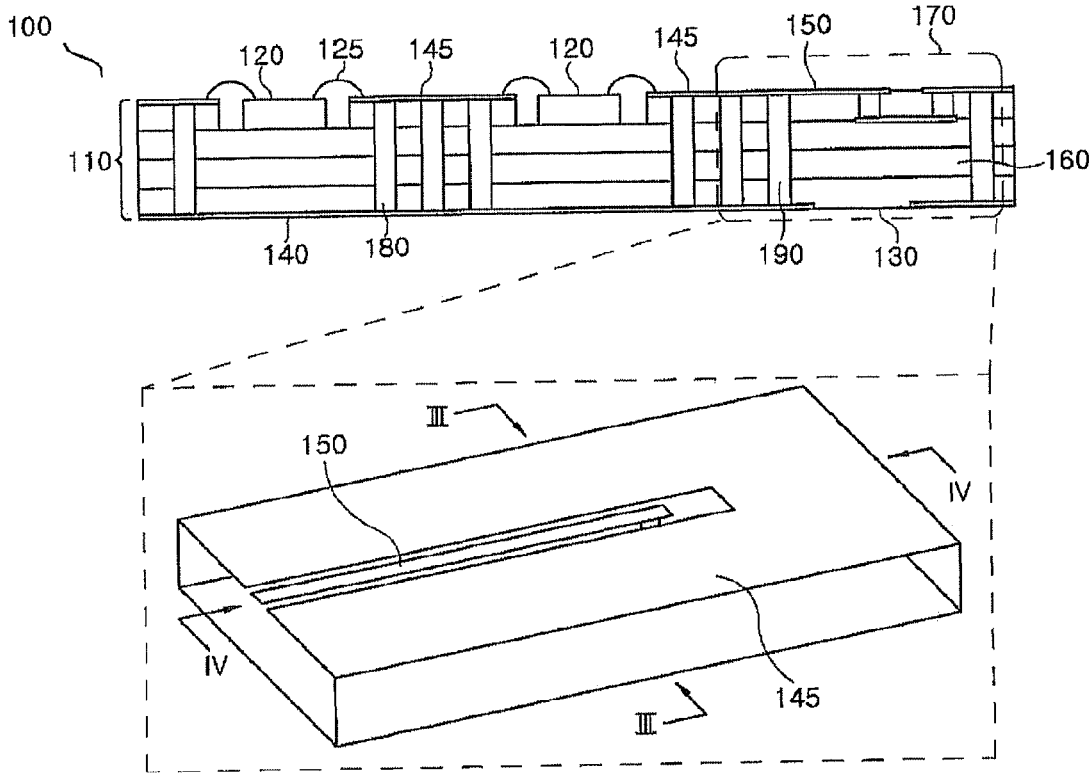
FIG. 1 shows a schematic view of a wireless communication module in accordance with the present invention, which includes a cross-sectional view of the wireless communication module having a built-in planar transmission line-to-waveguide transition apparatus, and an enlarged perspective view of the planar transmission line-to-waveguide transition apparatus.

FIG. 1 shows a schematic view of a wireless communication module in accordance with the present invention, which includes a cross-sectional view of the wireless communication module having a built-in planar transmission line-to-waveguide transition apparatus, and an enlarged perspective view of the planar transmission line-to-waveguide transition apparatus.

As shown in FIG. 1, a wireless communication module, which operates at millimeter-wave bands and is configured by a SiP technique, includes a multi-layer substrate 110 formed by using an LTCC (low temperature co-fired ceramic). The wireless communication module further includes plural MMICs 120 placed on the uppermost surface of the multi-layer substrate 110, and a planar transmission line 150 such as a microstrip line or a coplanar waveguide (CPW) formed for communications between the MMICs. The planar transmission line 150 and the MMICs 120 are connected to each other via a bonding wire 125. In the wireless communication module 100, a metal base 140 of the ground plane is formed on the rear surface of the multi-layer substrate 110. The metal base 140 has an opening 130 through which an antenna (not shown) is installed. Further, the metal base 140 is connected to the ground plane 145 of the planar transmission line 150 through vias 180 passing through the multi-layer substrate 110, thereby making the potential of the ground planes of the multi-layer substrate 110 identical with each other.

The vias 180, which are made of a metal, are aligned from the uppermost ground plane 145 of the planar transmission line 150 to the lowermost base metal 140, thus maintaining the constant potential from top to bottom, and a via fence composed of the vias 180 is forming an embedded waveguide 160 within the multi-layer substrate 110 where the antenna is to be installed. The embedded waveguide 160 is formed over the opening 130 of the metal base 140.

The embedded waveguide 160 is formed with rectangular shape for example, by being surrounded with vias 190. However, because of the limitations on the manufacturing process, the gap between the vias is too wide to trap signals within the multi-layer substrate 110. Therefore, according to the present invention, the embedded waveguide 160 is formed using the staggered via fence with double row technique, in which a first array of vias 190 are arranged to surround the embedded waveguide 160 in every ceramic layer and a second array of vias 190 are arranged in a staggered pattern behind the first array of vias in order to ensure that signals are trapped within the multi-layer substrate 110. For example, if vias 190 need to be arranged 400 μm apart from each other, due to the limitations on the existing process, the staggered via fence with double row technique can achieve similar effects to those having vias 200 μm apart from each other.

The wireless communication module further includes a planar transmission line-to-waveguide transition apparatus 170. The planar transmission line-to-waveguide transition apparatus serves to connect the planar transmission line 150 and the embedded waveguide 160 and in turn the antenna. Detailed description of the planar transmission line-to-waveguide transition apparatus will be made with reference to FIG. 2.

Figure 2:
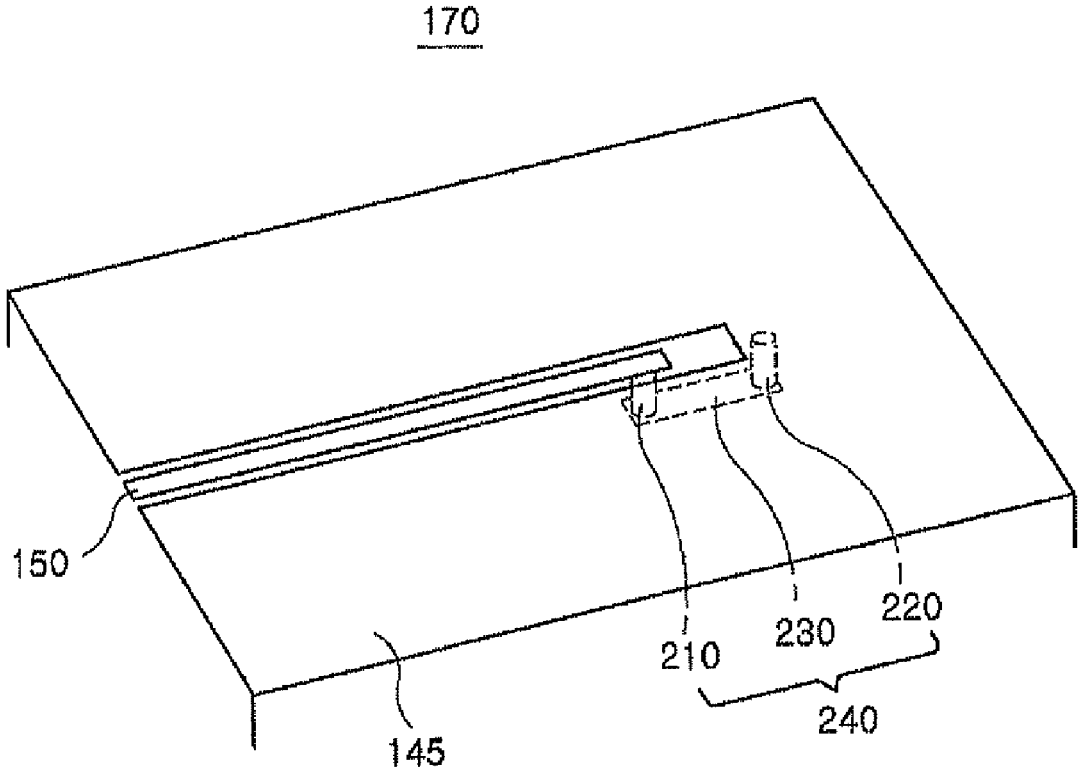
FIG. 2 illustrates a detailed view of the configuration of the planar transmission line-to-waveguide transition apparatus in accordance with the present invention.

FIG. 2 illustrates a detailed view of the configuration of the planar transmission line-to-waveguide transition apparatus in accordance with the present invention.

The planar transmission line-to-waveguide transition apparatus 170 includes a bent stub 240 that is built in the embedded waveguide 160 of FIG. 1. The bent stub 240 serves to induce an effective transition of waves between the planar transmission line 150 and the embedded waveguide 160 of FIG.1. The bent stub 240 includes first and second vias 210 and 220 spaced from each other and a microstrip line 230 to connect the first and second vias 210 and 220. The microstrip line 230 is installed on the embedded waveguide 160 of FIG. 1 and the first and second vias 210 and 220 are mounted on the microstrip line 230. The upper side of the first via 210 is connected to another end of the signal transmission line 150, and the upper side of the second via 220 is connected to the ground plane 145 of the planar transmission line 150. The vias 210 and 220 are 150 μm in diameter and are spaced 450 μm apart from each other. Such a bent stub 240 forms a bent loop to connect the planar transmission line 150 to the embedded waveguide 160 of FIG. 1 so that signal transition occurs therebetween.

Quasi-TEM or TEM mode signals are applied to the planar transmission line 150, and TE10 mode signals are transmitted from the embedded waveguide 160. To be more specific, when electric current flows to the bent stub 240, the electric current is induced along the bent stub 240. This causes a strong H-field to apply towards one side from the center of the short stub 240 and the H-field is formed suitably for the size of the embedded waveguide 160, so that characteristic frequency of the wireless communication module is determined depending on the size of the waveguide 160. As a result, the TE10 mode signal with a specific frequency suitable for the transition apparatus 170 is transmitted to the antenna via the opening 130. Therefore, signals can be transmitted using the bent stub 240 of the transition apparatus 170 from the planar transmission line 150 to the waveguide 160 and in turn to the antenna, and vice versa.

Figure 3:
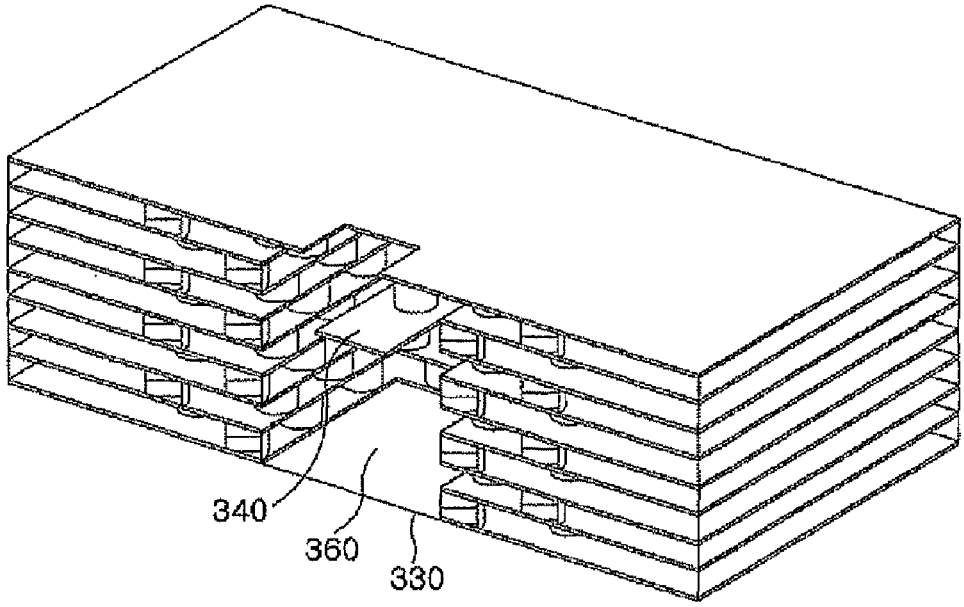
FIG. 3 shows a perspective view of a wireless telecommunication module in accordance with a first embodiment of the present invention, taken along line III-III of FIG. 1.
Figure 4:
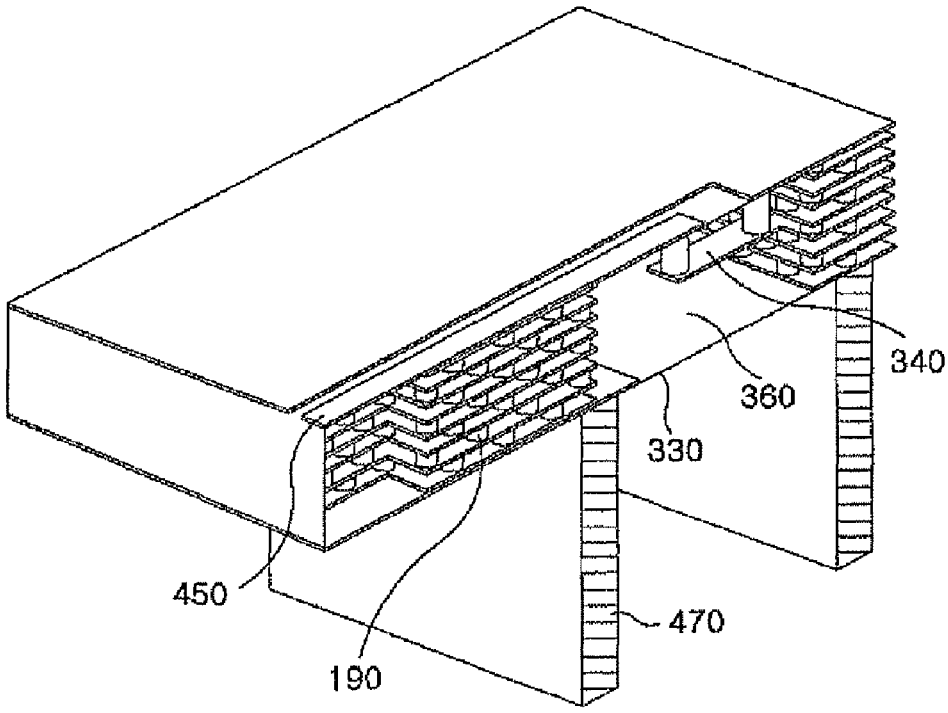
FIG. 4 shows perspective views of a wireless telecommunication module with an antenna in accordance with a first embodiment of the present invention, taken along lines TV-IV of FIG. 1.

FIG. 3 shows a perspective view of a wireless telecommunication module in accordance with a first embodiment of the present invention, taken along line III-III of FIG. 1; and FIG. 4 shows perspective views of a wireless telecommunication module with an antenna in accordance with a first embodiment of the present invention, taken along lines IV-IV of FIG. 1.

As shown in these drawings, the wireless telecommunication module includes an embedded waveguide 360 and a transition apparatus having a bent stub 340 and a signal transmission line 450 (FIG. 4). Reference numeral 470 (FIG. 4) denotes an antenna or an external structure such as WR15 installed on the wireless communication module where an opening 330 is formed. Further, the embedded waveguide 360 has a constant width from the bent stub 340 toward the opening 330. The wireless communication module shown in FIGS. 3 and 4 is suitable for use with narrow-band characteristics.

Figure 5:
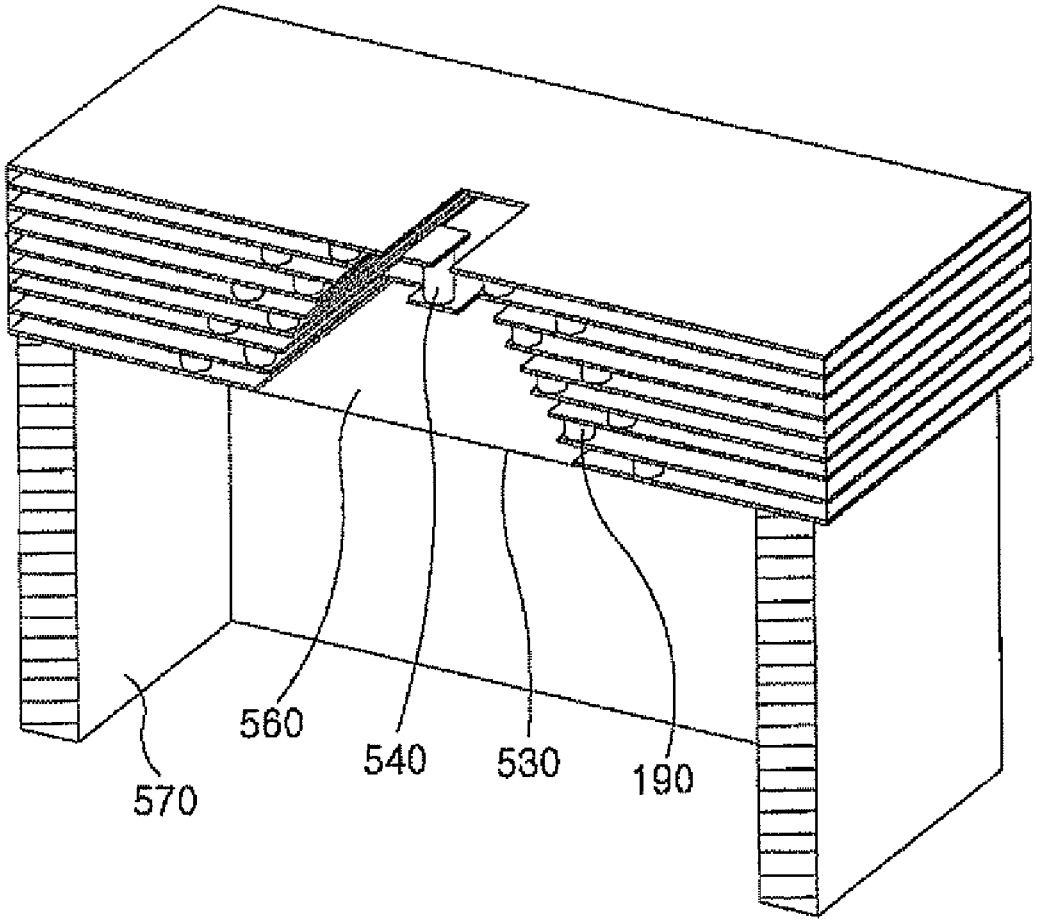
FIG. 5 shows perspective views of a wireless telecommunication module with an antenna in accordance with a second embodiment of the present invention, taken along lines IV-IV of FIG. 1.

FIG. 5 shows perspective views of a wireless telecommunication module with an antenna in accordance with a second embodiment of the present invention, taken along lines IV-IV of FIG. 1. Regarding FIG. 5, features having reference characters that have already been described are not described here.

In FIG. 5, reference numeral 570 denotes an antenna or an external structure such as WR15 installed on the wireless communication module where an opening 530 is formed. Further, the embedded waveguide 560 has the inner width gradually increasing from a bent stub 540 toward the opening 530. The wireless communication module shown in FIG. 5 is suitable for use with wide-band characteristics.

As can be seen from FIGS. 3 to 5, the wireless communication module of the present invention includes a waveguide formed by vias having staggered arrangement in dual row within the multi-layer substrate 110 of FIG. 1, and therefore, an additional mechanical waveguide, besides the waveguide already formed, is not needed. Also, as can be seen from FIG. 5, by making the embedded waveguide formed by vias 190 gradually wider in width, small insertion loss and wide bandwidth is assured.

Figure 6A:
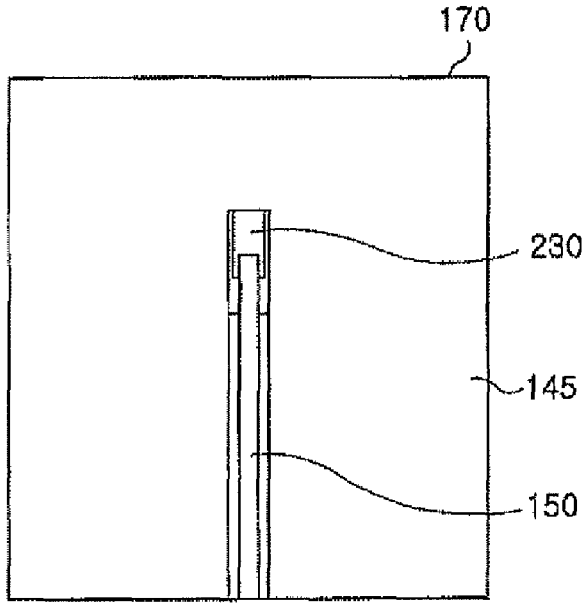
FIG. 6A shows a plan view of the planar transmission line-to-waveguide transition apparatus shown in FIG. 1 with a ground plane of a coplanar waveguide (CPW)
Figure 6B:
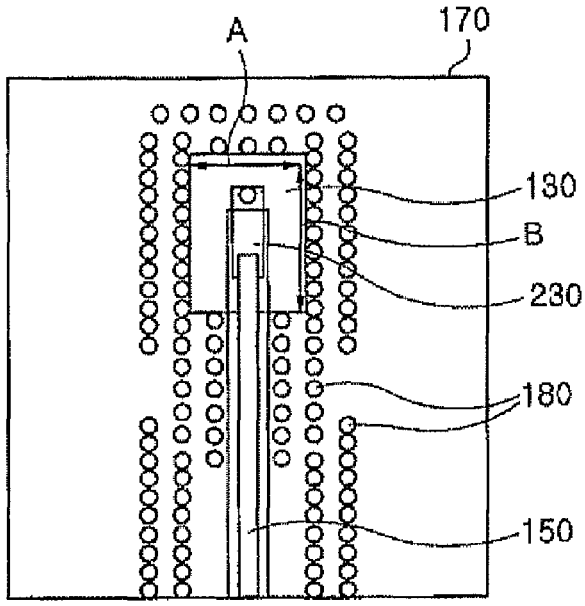
FIG. 6B shows a plan view of the planar transmission line-to-waveguide transition apparatus shown in FIG. 1 with a ground plane of a CPW omitted.

FIG. 6A shows a plan view of the planar transmission line-to-waveguide transition apparatus in FIG. 1 with the ground plane of a CPW, and FIG. 6B depicts a plan view of the planar transmission line-to-waveguide transition apparatus in FIG. 1 without the ground plane of the CPW. Regarding FIG. 6A and FIG. 6B, features having reference characters that have already been described are not described here. In FIG. 6B, assuming that the width of the embedded waveguide 160 is 'A' and the length thereof is 'B'. Then, the operation frequency of the wireless communication module is determined by the width 'A'. Therefore, in order to have a wide bandwidth, the width 'A' needs to increase gradually and the length 'B' needs to stay constant, thereby realizing the configuration shown in FIG. 5. That is, vias are arranged in such a way of gradually increasing from the bent stub where transition occurs toward the opening where the antenna joins, thereby enduring a wide bandwidth.

Figure 7A:
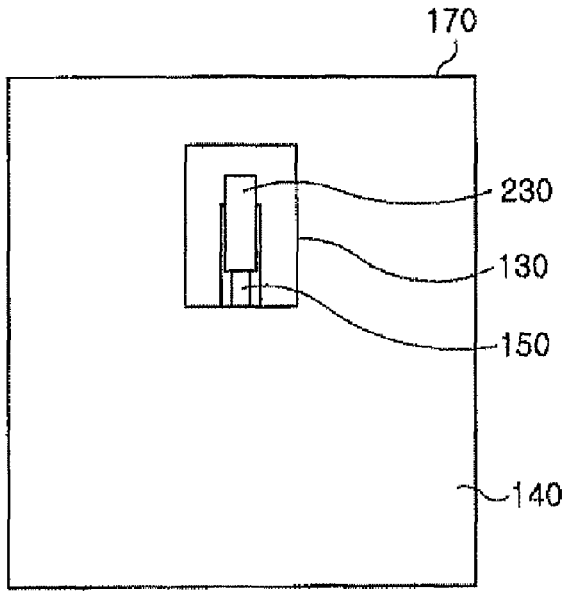
FIG. 7A provides a bottom view of the planar transmission line-to-waveguide transition apparatus with a ground plane of a metal base shown in FIG. 1.
Figure 7B:
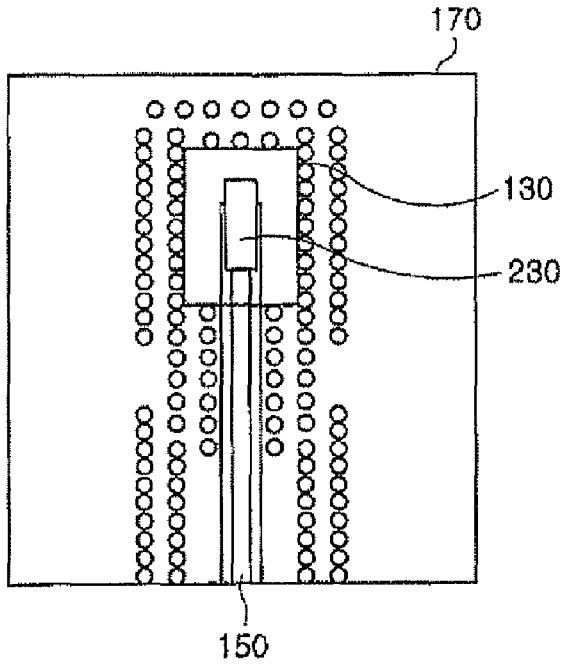
FIG. 7B shows a bottom view of the planar transmission line-to-waveguide transition apparatus with a ground plane is of a metal base omitted shown in FIG. 1.

FIG. 7A illustrates a bottom view of the planar transmission line-to-waveguide transition apparatus in FIG. 1 with a ground plane of a metal base, and FIG. 7B depicts a bottom view of the planar transmission line-to-waveguide transition apparatus in FIG. 1 with a ground plane of a metal base omitted. Regarding FIG. 7A and FIG. 7B, features having reference characters that have already been described are not described here. As can be seen from FIG. 7A, the ground plane occupies almost the entire portion of the planar transmission line-to-waveguide transition apparatus.

Figure 8:
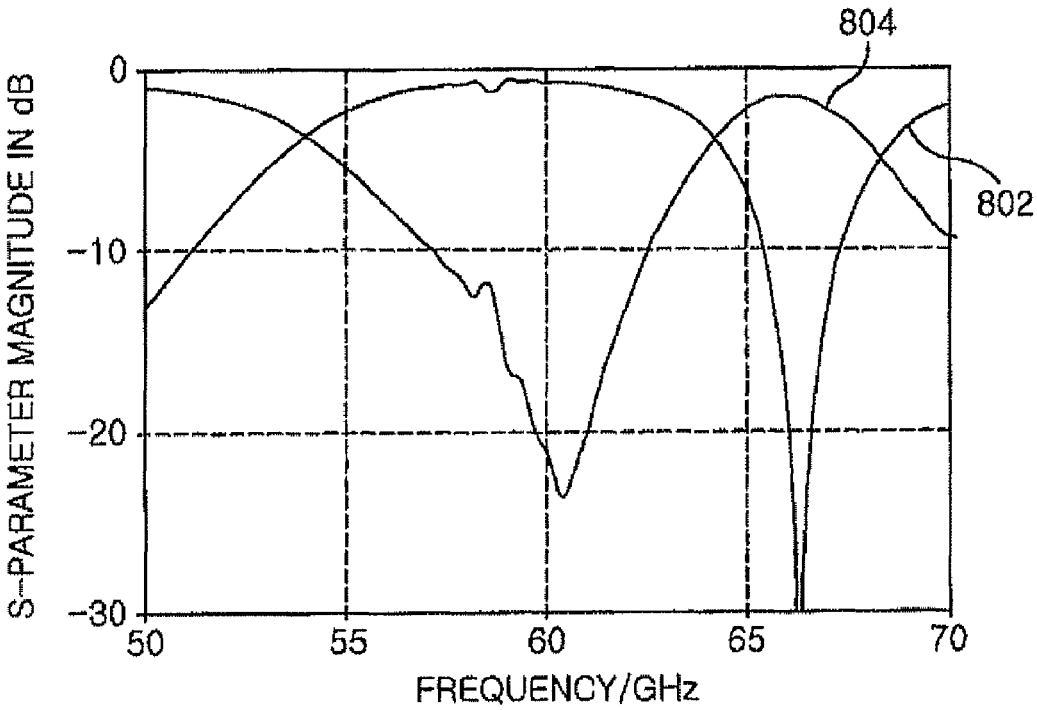
FIG. 8 is a graph illustrating simulation results of insertion loss and return loss of the wireless communication module in accordance with the present invention.

FIG. 8 is a graph illustrating simulation results of insertion loss and return loss of the transition apparatus in accordance with the present invention. In the graph of FIG. 8 the S-parameter Magnitude in dB is plotted along the Y axis, and the frequency in GHz of the signal is plotted along the X axis. In FIG. 8, reference numeral 802 indicates the insertion loss after a signal applied to the planar transmission line 150 passes sequentially through the short stub 240, the embedded waveguide 160 and the external waveguide (i.e., the antenna), and reference numeral 804 indicates the return loss of a signal as it passes sequentially through the short stub 240, the embedded waveguide 160 and the external waveguide (i.e., the antenna). As can be seen from FIG. 8, considering that the return loss to be expected as a signal passes through the structures is 10 dB or more, the insertion loss by the configuration of the present invention is at most 0.4 dB and thus it is possible to entirely cover a 60 GHz-band for the return loss ranging from 57 to 64 GHz.

As explained so far, the planar transmission line-to-waveguide transition apparatus proposed by the present invention is made in super-small size, does not require any additional mechanical process and has a wide bandwidth with low insertion loss, and thus, it is suitable for implementing millimeter-wave band wireless communication modules with a small size and low price.

In particular, by adopting the antenna attached to the rear side of the wireless communication module, instead of attaching the antenna to the same plane with the MMIC, the wireless communication module can ensure isolation between the antenna and the MMIC. Moreover, as the entire size of the wireless communication module is reduced significantly, small size and low price modules can be implemented. In addition, by configuring the transition apparatus in a way that the signal transition is made within the embedded waveguide, the transfer loss of the signal can be minimized.

Especially, the transition apparatus of the present invention can be advantageously used in the SiP field where smaller size and lower manufacturing costs are required, as well as in millimeter-wave band wireless communication modules where low insertion loss and wide bandwidth are needed.

While the invention has been shown and described with respect to the particular embodiments, it will be understood by those skilled in the art that various changes and modification may be made without departing from the scope of the invention as defined in the following claims.

What is claimed is:

1. A wireless communication module, comprising:

a multi-layer low temperature co-fired ceramic (LTCC) substrate;

a plurality of monolithic millimeter-wave integrated circuits (MMICs) attached to the top surface of the multi-layer substrate for signal processing;

a planar transmission line formed on the top surface of the multi-layer substrate for communications between the MMICs;

a metal base which is attached to the bottom surface of the multi-layer substrate, and has an opening to which an antenna is attached;

a plurality of vias, for connecting the metal base and the planar transmission line, within the multi-layer substrate to establish a uniform potential on a ground plane of the multi-layer substrate;

an embedded waveguide formed over the opening and surrounded with the vias within the multi-layer substrate; and a planar transmission line-to-waveguide transition apparatus for the transition of waves between the planar transmission line and the embedded waveguide, wherein the planar transmission line-to-waveguide transition apparatus includes a bent stub that is built in the embedded waveguide, the bent stub including first and second vias spaced from each other and a transition line installed on the embedded waveguide to connect the first and second vias, and wherein the first and second vias are located in an identical layer.

2. The wireless communication module of claim 1, wherein the bent stub forms a bent loop to connect the planar transmission line to the embedded waveguide so that signal transition occurs therebetween.

3. The wireless communication module of claim 2, wherein an upper side of the first via is connected to another end of the planar transmission line, and an upper side of the second via is connected to a ground plane of the planar transmission line.

4. The wireless communication module of claim 1, wherein the embedded waveguide is formed in a such a way that a first array of vias are arranged to surround the embedded waveguide and a second array of vias are arranged in a staggered pattern behind the first array of vias to configure a via fence with double rows.

5. The wireless communication module of claim 1, wherein the embedded waveguide has an inner width made gradually wider from the bent stub toward the opening.

6. The wireless communication module of claim 5, wherein an inner length of the embedded waveguide stays constant from the bent stub toward the opening, while the inner width is gradually wider from the bent stub toward the opening.

7. The wireless communication module of claim 1, wherein the embedded waveguide has an inner width made uniform from the bent stub toward the opening.

8. A planar transmission line-to-waveguide transition apparatus, formed in a multi-layer substrate, for the transition of waves between a planar transmission line and a waveguide, comprising:

a bent stub that is built in the waveguide and forms a bent loop to connect the planar transmission line to the waveguide so that signal transition occurs therebetween, wherein the bent stub includes first and second vias spaced from each other and a transition line installed on the waveguide to connect the first and second vias, and wherein the first and second vias are located in an identical layer.

9. The planar transmission line-to-waveguide transition apparatus of claim 8, wherein the waveguide is formed in a such a way that a first array of vias are arranged to surround the waveguide and a second array of vias are arranged in a staggered pattern behind the first array of vias to configure a via fence with double rows.

10. The planar transmission line-to-waveguide transition apparatus of claim 8, wherein the waveguide has an inner width made gradually wider from an upper end of the waveguide where the bent stub is located toward a lower end of the waveguide.

11. The planar transmission line-to-waveguide transition apparatus of claim 10, wherein an inner length of the waveguide stays constant from an upper end of the waveguide where the bent stub is located toward a lower end of the waveguide, while the inner width is gradually wider from the upper end of the waveguide toward the lower end of the waveguide.

12. The planar transmission line-to-waveguide transition apparatus of claim 8, wherein an upper side of the first via is connected to another end of the planar transmission line, and an upper side of the second via is connected to a ground plane of the planar transmission line.

13. The planar transmission line-to-waveguide transition apparatus of claim 8, wherein the waveguide has an inner width made uniform from an upper end of the waveguide where the bent stub is located toward a lower end of the waveguide.

* * * * *